US007578224B2

(12) United States Patent
Halamoda et al.

(10) Patent No.: US 7,578,224 B2
(45) Date of Patent: Aug. 25, 2009

(54) PUNCHING DEVICE AND PUNCHING DIE FOR IT

(75) Inventors: Hans-Joachim Halamoda, Albstadt (DE); Siegfried Beerhalter, Schwäbisch-Gmünd (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/148,213

(22) Filed: Jun. 9, 2005

(65) Prior Publication Data

US 2005/0274251 A1 Dec. 15, 2005

(30) Foreign Application Priority Data

Jun. 9, 2004 (DE) ..... 20 2004 009 138 U

(51) Int. Cl.
*B26F 1/14* (2006.01)

(52) U.S. Cl. ..... 83/698.91; 83/687

(58) Field of Classification Search ..... 83/698.91, 83/684–691, 697; 76/101.1
See application file for complete search history.

(56) References Cited

U.S. PATENT DOCUMENTS 2,359,682 A * 10/1944 Ruder ..... 83/685
3,186,284 A * 6/1965 Bennett ..... 83/623
3,334,406 A * 8/1967 Bennett ..... 29/407.09
3,379,083 A 4/1968 Burns et al.
3,650,163 A 3/1972 Juffs
3,974,728 A 8/1976 Herlan
4,700,601 A 10/1987 Simon
4,872,381 A 10/1989 Stroms
6,481,323 B1 11/2002 Beerhalter

FOREIGN PATENT DOCUMENTS

CH 638 714 A 10/1983
EP 0 354 152 B1 10/1994
EP 1 005 963 A 6/2000

* cited by examiner

*Primary Examiner*—Stephen Choi
(74) *Attorney, Agent, or Firm*—Fitch, Even, Tabin & Flannery; Norman N. Kunitz

(57) ABSTRACT

The punching die of the invention has a head 22 held by positive engagement. The head 22 is held on the shaft 21 of the die 8 in that by means of plastic deformation, for instance by radial application of pressure, material is positively displaced radially inward, so that a protrusion 28 is embodied which rests over a large area on the wall of a recess 23. A more secure, more durable force transition is assured.

20 Claims, 6 Drawing Sheets

PUNCHING DEVICE AND PUNCHING DIE FOR IT

CROSS REFERENCE TO RELATED APPLICATION

This application claims the priority of German Patent Application No. 20 2004 009 138.0, filed on Jun. 9, 2004, the subject matter of which, in its entirety, is incorporated herein by reference.

FIELD OF THE INVENTION

The invention relates to a punching device and its punching die. In particular, the invention relates to a punching device and a punching die for unfired sheetlike ceramic substrates, in particular so-called green sheets.

BACKGROUND OF THE INVENTION

Green sheets must as a rule, in their production, be provided with a number of small holes that are later used for through-contacting conductors that are mounted on the ceramic substrates. These are relatively small holes, of markedly less than one millimeter in diameter, and such holes must be made in large numbers. The punching device has a correspondingly large number of punching dies. The punching dies are provided with heads that are held in a holding device, such as a holder plate, in order to be moved with it in the longitudinal direction of the shaft, or in other words for instance up and down.

A similar punching device is known for instance from European Patent Disclosure EP 0 354 152 B1. The punching dies here are driven by magnet drives. These punching dies are likewise provided with a head that is mounted on the elongated shaft of the punching die.

In performing their job, the punching dies are exposed to a severe abrasive stress. They must therefore be made of a suitable wear-resistant hard material. They are therefore made of an elongated, needle-like body, on which the head, typically of a different material, for engagement by the head plate or other drive mechanisms, is attached later.

As known for instance from U.S. Pat. No. 3,974,728, the working part of a punching die may also be inserted into a body provided with a head and secured to this body for instance by adhesive. However, this makes production relatively complicated. Since punching dies are considered to be wearing parts, it must be attempted to be able to produce them as fast, simply and inexpensively as possible, yet without sacrificing quality. Quality, however, is definitively determined by the straightness or in other words precision of the punching die. Adhesive points between a cylindrical driving body and a cylindrical working part are critical here.

From U.S. Pat. No. 4,700,601, it is also known for punching dies that are intended for punching paper to be provided with a plastic head. To that end, the metal punching die has an annular groove. The region provided with the annular groove is then sheathed with an extruded cylindrical plastic body, whereupon the plastic partly flows into the annular groove and thus makes a positive-engagement connection between the head and the die.

As a rule, the punching dies for green sheets cannot be provided with plastic heads. Because of the small diameter of the shafts of the punching dies, as a rule adequately durable positive-engagement connections are not obtained between a plastic head and the punching die.

With this as the point of departure, it is the object of the invention to create a punching die for a green sheet punching device as well as to create a corresponding punching device; the punching dies should be simple and economical to produce and should meet high standards for quality.

SUMMARY OF THE INVENTION

The above object generally is attained according to the invention with a punching die for a green sheet punching device, with the punching die comprising a shaft that is provided on one end with at least one recess; and an annular head, which has a protrusion, created by plastic deformation, on its inner surface that engages the recess, and thereby secures the head on the shaft by positive engagement.

The above object is moreover generally attained according to the invention by a green sheet punching device having a punching die according to the invention as generally described above.

The punching die of the invention has a die shaft, which has a head on one end and a working part on the opposite end. On the head end, the die shaft is provided with at least one recess on its jacket face. An annular head is seated in the region of the recess and has a protrusion that engages the recess and thereby secures the head on the shaft by positive engagement. This protrusion is created by plastic deformation of the head. The consequence as a rule is that the material of the head rests with a certain prestressing on the shaft. This is particularly true if the head is made from a suitable metal, such as steel, brass, or aluminum. Unlike an extruded plastic sheath, which can already loosen somewhat as a consequence of natural shrinkage or volatility of the plastic, a firm seat is assured here.

Producing the punching die can be done with very short cycle times. A head blank need merely be slipped over the shaft and then secured on the shaft by a suitable deformation process for the plastic deformation of the head. The production processes with which this can be achieved are for example embossing, pressing, rolling, hammering, or other methods for non-metal-cutting shaping. If the head is of a metal with a low melting point, it could if necessary also be produced by a casting process, such as diecasting. However, this is considered to be less advantageous, because the effort involved is greater.

The protrusion that secures the head to the shaft is created, as noted, preferably by plastic deformation of the head blank. To that end, an indentation is embodied on the head in production. The shape of the indentation preferably corresponds to the shape of the recess provided on the shaft. If the recess is an annular bead, for instance, then an annular indentation is embodied on the otherwise cylindrical outer circumferential surface of the head. As a result, the requisite plastic deformation of the head is kept to a minimum. However, it is also possible to provide a supplementary counterholding or deforming pressure, for example in the axial direction against the head, in order to promote the radially inward-oriented inflow of head material into the recess of the shaft.

The recess of the shaft preferably has a waistlike shape. Sharp edges are avoided, in order not to favor breaking off of the slender shaft in the region of the recess. The recess is preferably defined by a concave annular face which is embodied without edges or shoulders. The indentation then has a suitably adapted shape.

The head is preferably seated on the end of the shaft that is diametrically opposite the working part. It is preferably seated on the end of the shaft, so that the shaft end is flush with the head or protrudes slightly out of the head. It has proved advantageous for the recess and correspondingly the protrusion of the head that engages the recess to be disposed near the shaft end. The opening in the head, on the side facing away from the shaft end, thus has a cylindrical guide portion, which transmits tilting moments that engage the head to the shaft or is braced on the shaft without stressing the zone of the shaft that is weakened by the recess. This is particularly applicable if the recess in the shaft, as is preferably the case, is flush with the upper plane face, oriented toward the shaft end, of the head.

Before its plastic deformation, the head preferably has a through bore whose width is somewhat greater than that of the shaft, so that the shaft can be introduced into the head with slight play. After the plastic deformation, the head is seated without play on the shaft. The through bore in the head has preferably been narrowed over its entire length enough that the head is seated without gaps on the shaft.

Besides securing the head to the shaft by positive engagement, connecting it by material engagement may also be provided. This may for instance be an adhesive connection or bond. The advantage of this provision is for instance the ease of introducing the adhesive, which can be accommodated in the recess of the shaft before the plastic deformation operation.

It is also possible for the adhesive, for positively securing the head to the shaft, to be introduced after the plastic deformation of the head, in that after it is applied the adhesive is drawn in between the shaft and the head by capillary action.

In a departure from the embodiments described above, instead of one recess a plurality of recesses may also be provided, and then the above remarks apply accordingly. The recesses may extend around the entire circumference of the shaft or only over a portion thereof and may be axially spaced apart from one another or located at the same height.

Further advantageous details of embodiments of the invention are the subject of the drawings, description, and/or claims.

BRIEF DESCRIPTION OF THE DRAWINGS

Exemplary embodiments of the invention are shown in the drawings. Shown are.

DETAILED DESCRIPTION OF THE INVENTION

Figure 1:
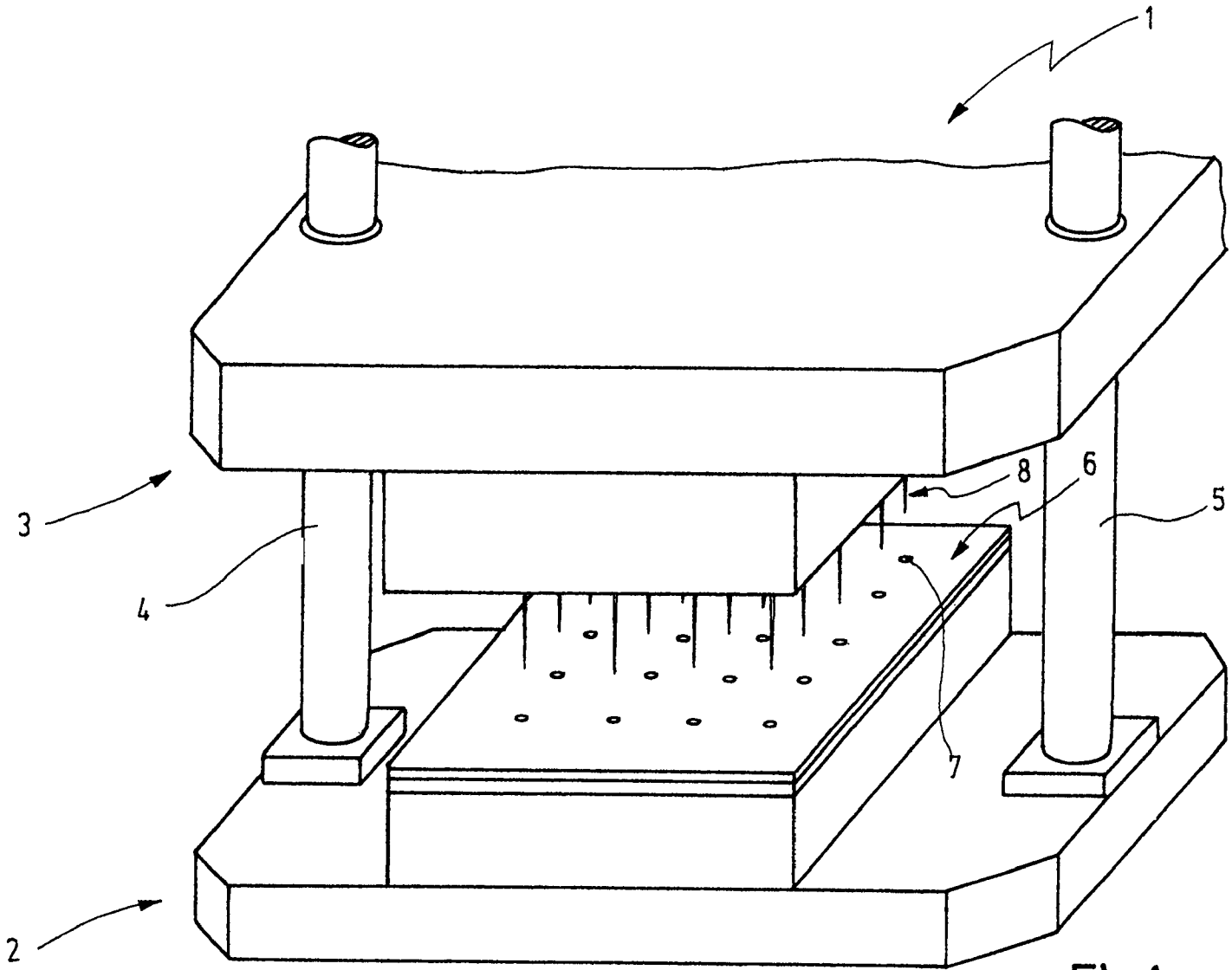
FIG. 1, a punching device for green sheets, in a schematic, perspective basic view.

In FIG. 1, a punching tool 1 is shown, which includes a lower tool 2 and an upper tool 3. The upper tool 3 can be moved linearly back and forth by means of two guides 4, 5 toward the lower tool 2 and away from it. The lower tool 2 includes a bearing plate or receptacle device 6, in which punched holes 7 are embodied. The punched holes 7 are embodied in great numbers in the bearing plate 6 and are located at points where holes are to be punched out in a green sheet (unfired ceramic substrate) placed on the bearing plate 6. To that end, dies 8 are disposed on the upper tool 3; they point toward the lower tool 2 and end above the bearing plate 6. The dies 8 can plunge into the punched holes 7 when they are moved downward. Above the bearing plate 6, there is a holding-down plate 9 for guiding the dies 8 and holding down the green sheets resting on the bearing plate; the holding-down plate has been left out in FIG. 1 in order to provide a clear view on the punching dies 8 and the receptacle device 6.

Figure 2:
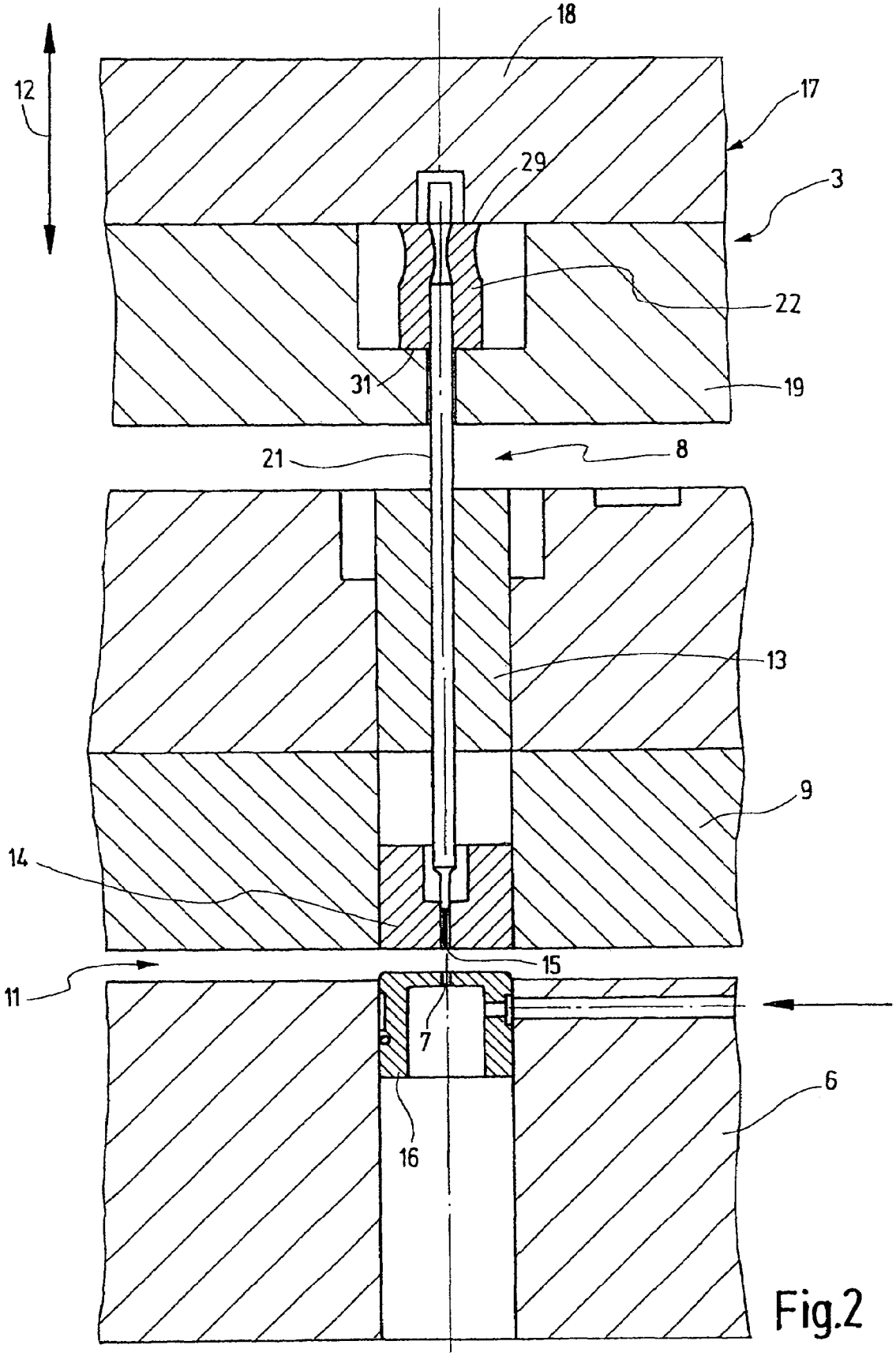
FIG. 2, the punching device of FIG. 1, in a fragmentary schematic view in longitudinal section.

The upper tool 3 along with the holding-down plate 9 are seen in FIG. 2. The holding-down plate 9 is disposed, vertically movably independently of the punching motion of the dies 8, above the bearing plate 6 and with it defines a gap 11 for receiving a green sheet, not shown. The holding-down plate 9 is connected to or is a part of the upper tool 3 and is movable with it. An arrow 12 indicates the direction of motion of the upper tool 3.

The die 8 is axially guided in the holding-down plate 9 by at least one guide bush 13 and optionally by a further guide bush 14 provided on the holding-down plate 9. The die 8, on its lower part, protruding into the guide bush 14, preferably has both a profile which is graduated multiple times and a slender working part 15. Associated with this working part is the punched hole 7, which is embodied in a bush 16 held in the receptacle device 6.

The punching die 8 is held axially nondisplaceably in an upper holding device 17, which serves to impart the axial motion to the die 8. The holding device 17 is part of the upper tool 3. In principle, it may be embodied in various ways. What is essential is that it has a drive element 18, which in the present exemplary embodiment is embodied as a plate and serves to move the die 8 downward. A retriever element 19 also belongs to the holding device 17 and in the present exemplary embodiment is embodied as a plate and serves to move the die 8 counter to its punching direction, that is, away from the receptacle device 6. The plates that form the drive element 18 and the retriever element 19 may be embodied as resting firmly against one another, as shown, or they may be embodied as movable counter to one another. They may be tensed against one another by spring means and firmly clamp the die 8 between them. Spring means, not shown, may also be provided between the die 8 and the holding device 17.

Figure 3:
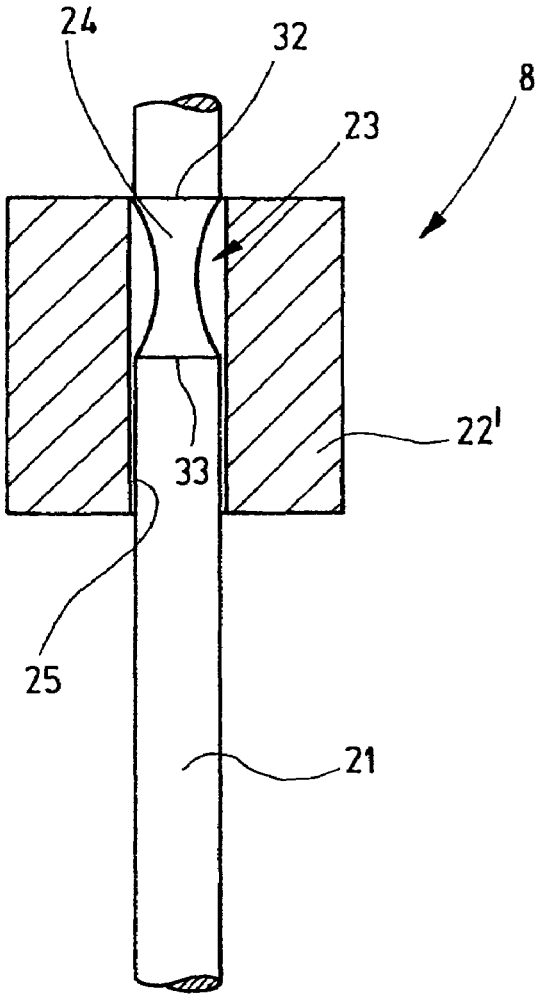
FIG. 3, a die before its head is secured to its shaft, in a basic view in longitudinal section.

The punching die 8 has at least one preferably cylindrical elongated shaft 21 and one likewise preferably cylindrical head 22, which are joined to one another by positive engagement. The shaft 21 and the head 22 preferably comprise different metals. The shaft 21 is optimized with regard to its punching properties. In particular at its working part 15, it is subject to not inconsiderable wear, particularly in the region of its cutting edges. This potential problem is addressed by means of a suitable choice of material. Hence the shaft 21 comprises a suitable steel. The head 22, conversely, serves merely to introduce the requisite driving forces into the die 8. Excessive hardness or wear resistance is not critical here. Hence it is made as a separate part from a suitable metal, such as a readily deformable steel, or other metals, and secured to the shaft 21. This is illustrated in detail in FIGS. 3 and 4. For the securing of the head 22, the shaft 21 has a recess 23, for instance in the form of a shallow annular bead surrounding the shaft 21. As FIG. 3 shows, this annular bead has a waist-like shape. The annular face 24 defining it is embodied without edges or shoulders. The axial length of the annular face 24 also far exceeds the greatest diameter of the annular face 24. Moreover, it has proved advantageous if the axial length also exceeds the circumference of the annular face 24, as measured at the point of the smallest diameter of the annular face 24.

The head 22 is embodied of an initially hollow-cylindrical blank 22', which has a central through bore 25. The diameter of the through bore is preferably somewhat greater than the diameter of the shaft, so that the blank 22' can be slipped over the shaft 21 without difficulties. For securing the blank 22' to the shaft 21 and thus for embodying the head 22, the blank 22' is deformed. This can be seen by comparing FIGS. 3 and 4. The head 22 is provided with an indentation 27 extending annularly around its cylindrical jacket face 26; this indentation is created by a radially inward-oriented upsetting of the head 22. The indentation 27 preferably corresponds in its shape to the shape of the recess 23. The material of the head 22 flows into the indentation 23, forming a radially inward-oriented riblike protrusion 28. Thus particularly in the region of the recess 23, the head 22 rests flatly and without gaps on the annular face 24. The head 22 may also be upset radially inward in its remaining region as well, so that its through bore 25 rests without gaps and preferably with a certain prestressing on the shaft 21. The head 22 thus has an upper plane face 29, serving to introduce force, and a lower plane face 31, also serving to introduce force, as well as a cylindrical jacket face 26, which is directly adjacent to the lower plane face 31 that faces toward the working part 15 of the shaft 21. The indentation 27, conversely, is preferably adjacent to the plane face 29. Also preferably, the head 22 is disposed such that the plane face 29 is essentially aligned with an upper edge 32, at which the cylindrical shaft 21 merges with the curved annular face 24. Conversely, the other edge 33, at which the annular face 24 ends, is preferably located approximately halfway up the height of the head 22.

The configuration presented here has the advantage that the head 22 can be mounted on the shaft 21 in an axially desired and selected position. The precision of the location of the recess 23 does not play a role. The position of the head 22 is defined at the moment when the head 22 is compressed. Other production tolerances play only a very subordinate role, if any. High-quality punching dies 8 can thus be produced in a simple way. Moreover, the most various embodiments can be created in the simplest possible way; for instance, variously shaped heads 22 can be combined with shafts 21 of one and the same type. Different axial head lengths or head diameters or head materials may be employed. Moreover, the heads 22 may be secured in various axial positions, in which the recess 23 is located inside the through bore 25. It is furthermore possible to make the recesses 23 at different positions along the shaft. This is particularly true if the indentations are created by a metal-cutting machining operation, such as grinding.

Figure 4:
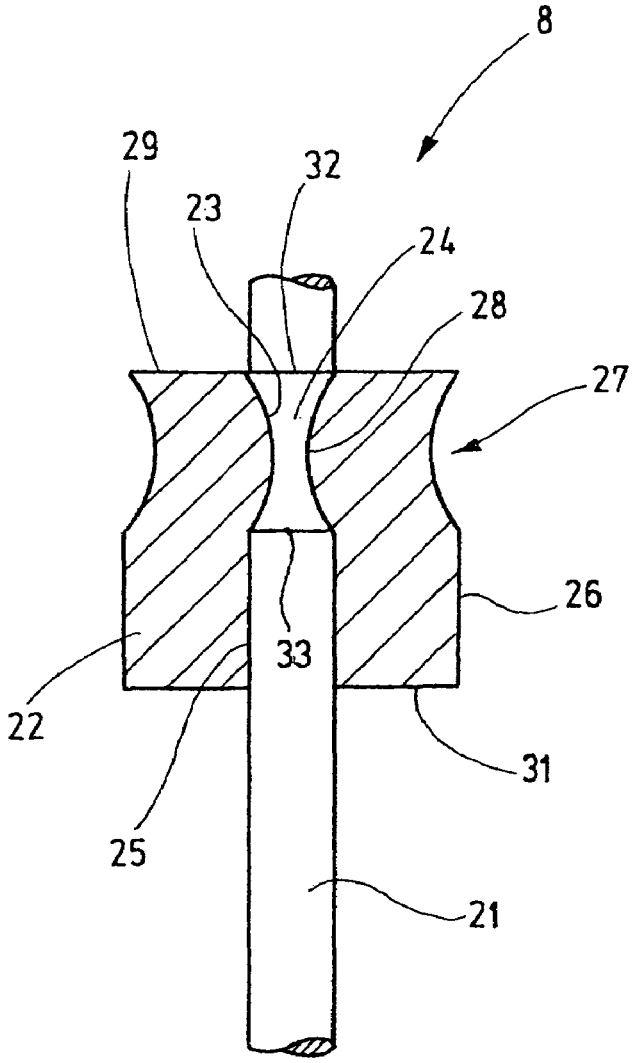
FIG. 4, the die with the head seated firmly on its shaft.

The punching die 8 described thus far functions in the punching tool 1 as follows:

As shown in FIG. 2, the upper tool 3 is moved back and forth in the direction of the arrow 12. The head 22 is retained between the drive element 18 and the retriever element 19. Both of these elements engage the plane faces 29, 31 of the head 22. The force transmission between the head 22 and the shaft 21 is effected by positive engagement between the protrusion 28 and the recess 23 (FIG. 4). The force transmission is two-dimensional and utilizes the entire annular face 24. Because of this, there are neither local excessive increases in tension nor shear effects. Even in high-speed work, the heads 22 do not come loose from the dies 8. This is of substantial advantage, which is due to the fact that the protrusion 28 and the recess 23 are of the same shape, or more precisely have shapes that are completely complementary to one another.

Figure 5:
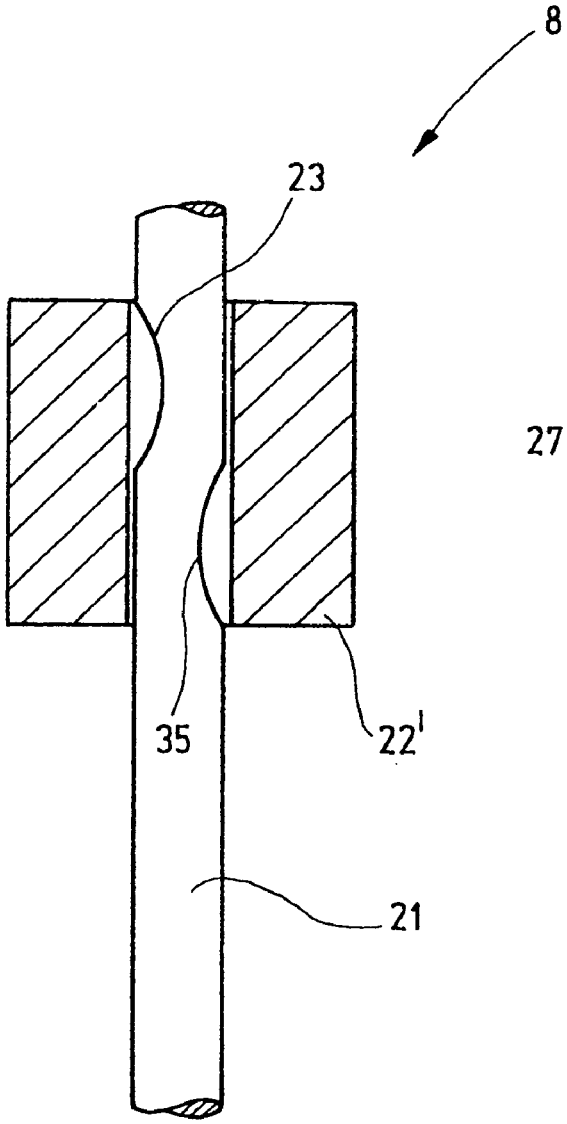
FIGS. 5 and 6, a die before and after its head is secured to the shaft, respectively, in an alternative embodiment, in longitudinal section.
Figure 6:
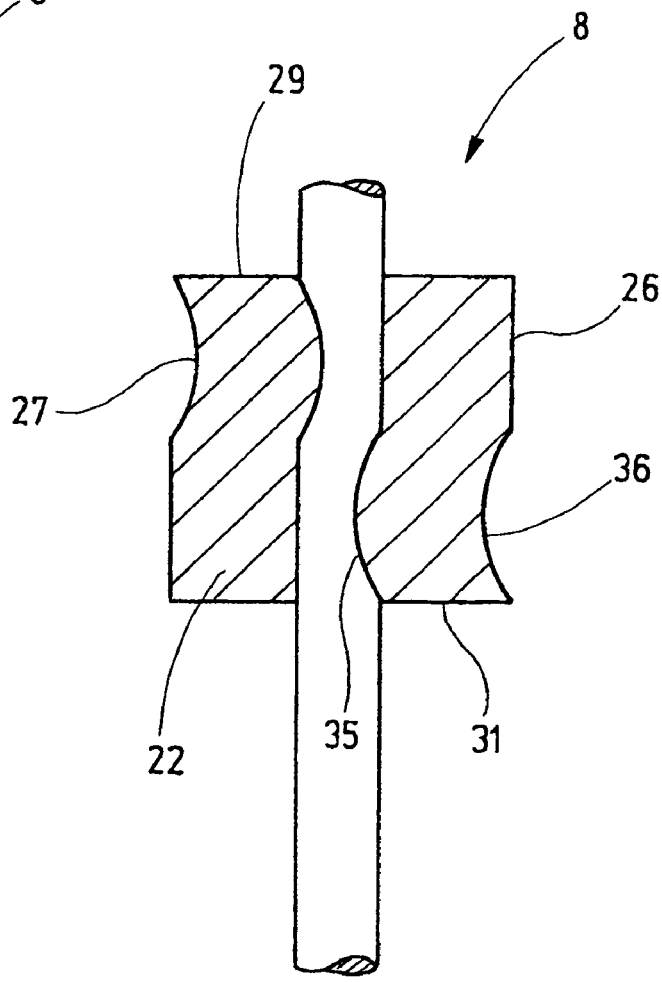

For the die 8 of FIGS. 5 and 6, the descriptions above apply, with the following exceptions:

The recess 23 does not extend over the entire circumference of the shaft 21, but rather only over part of it. They may be presented in the form of a rounded notch that for instance follows along a cylindrical jacket face. Optionally, on the diametrically opposite side and at the same height, or axially offset as shown, a further recess 35 may be provided, which has the same shape or a modified shape. Correspondingly, the head 22, after deformation of the blank 22', has a first, upper indentation 27 in the region of the upper recess 23 and an indentation 36 in the region of the lower recess 35. The indentations 27, 36 are created by radial compression and deformation of the blank 22' and form dents or impressions in the jacket face 26.

Figure 7:
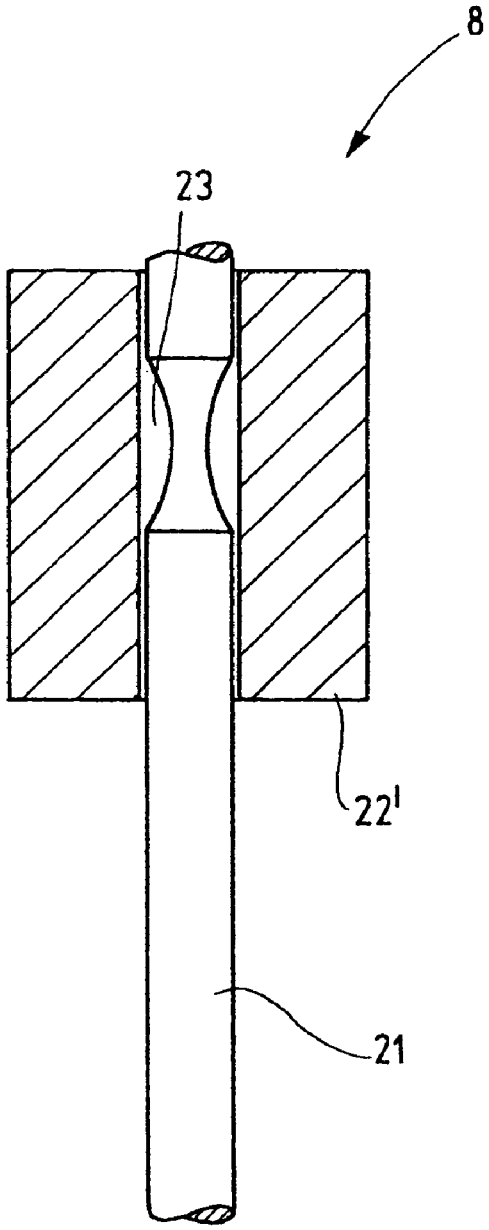
FIGS. 7 and 8, a die before and after its head is secured to the shaft, respectively, in an alternative further embodiment, in longitudinal section.
Figure 8:
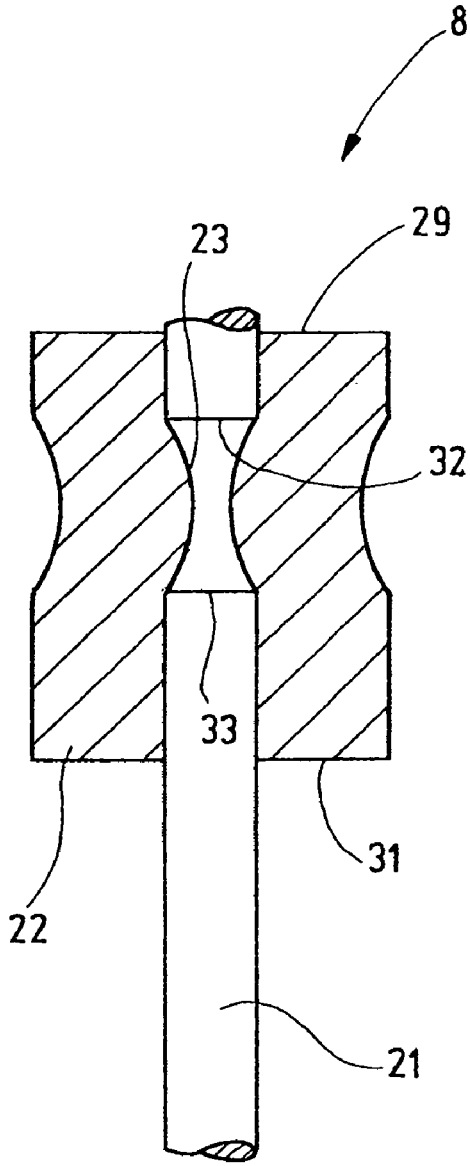

As FIGS. 7 and 8 show, the head 22 may also extend upward past the recess 23, so that the upper plane face 29 has an axial spacing from the edge 32. Preferably, however, between the lower plane face 31 of the head 22 and the lower edge 33 of the shaft 21, an axial spacing remains that is at least approximately as great as the axial length of the recess 23 and is substantially greater than the diameter of the shaft 21. As a result, the head 22 is retained in a tiltproof manner on the shaft 21.

Figure 9:
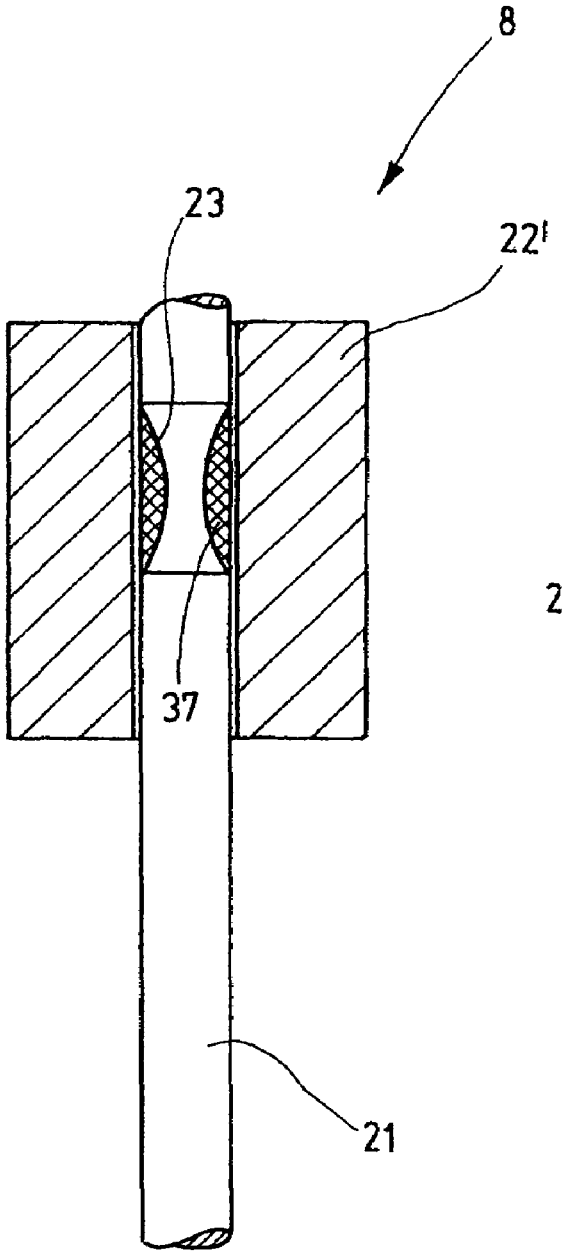
FIGS. 9 and 10, a punching die before and after its head is secured to the shaft, respectively, in an alternative, more sophisticated embodiment, in longitudinal section.
Figure 10:
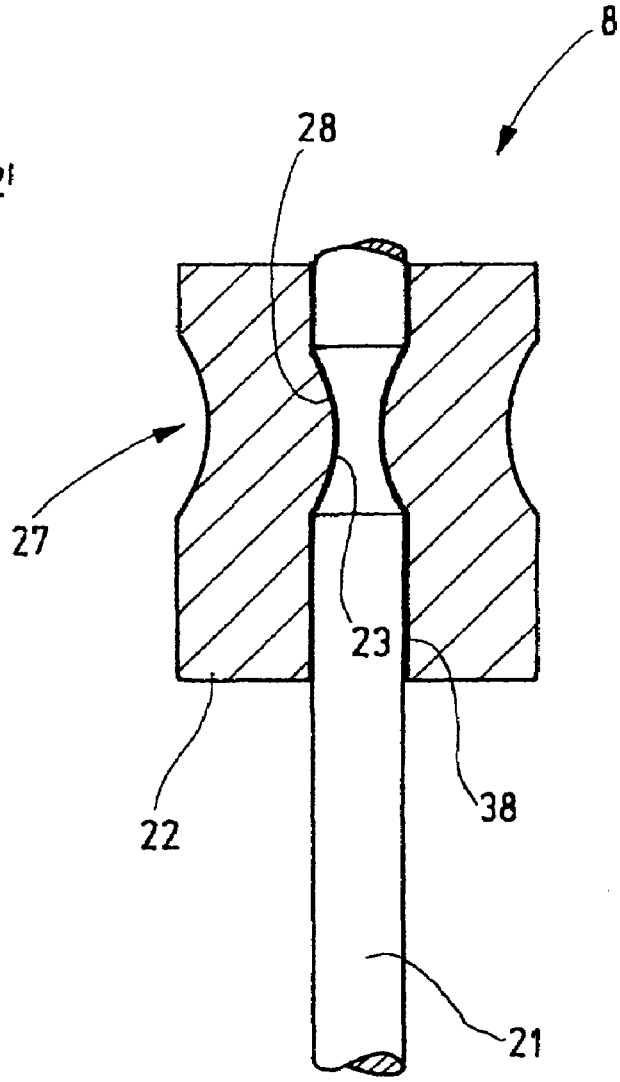

FIGS. 9 and 10 illustrate a modified exemplary embodiment of the die 8, in which the head 22, in addition to the positive-engagement securing, is secured to the shaft 21 by material engagement. For producing the connection, a suitable connection means is disposed in the recess 23, such as an adhesive 37 that cures as a result of pressure or heat or intimate contact with metal. This adhesive is not scraped off when the blank 22' is wiped and thus remains as a deposit in the recess 23. In the ensuing plastic deformation of the blank 22' and the embodiment of the protrusion 28, which penetrates into the recess 23, the adhesive 37 is largely positively displaced, whereupon it penetrates to both sides of the recess 23 into the gap formed between the head 22 and the shaft 21 and fills up this gap, forming an adhesive seam 38. The adhesive 27 can subsequently cure over the course of time. It may also be made to cure by means of heat. Adhesives that cure as soon as the adhesive seam shrinks below a minimum width, as is the case in some instant adhesives, may also be used.

The punching die of the invention has a head 22 held by positive engagement. The head 22 is held on the shaft 21 of the die 8 in that by means of plastic deformation, for instance by radial application of pressure, material is positively displaced radially inward, so that a protrusion 28 is embodied which rests over a large area on the wall of a recess 23. A more secure, more durable force transition is assured.

It will be appreciated that the above description of the present invention is susceptible to various modifications, changes and adaptations, and the same are intended to be comprehended within the meaning and range of equivalents of the appended claims.

LIST OF REFERENCE NUMERALS

1 Punching tool
2 Lower tool
3 Upper tool
4, 5 Guides
6 Receptacle device
7 Punched holes
8 Die
9 Holding-down plate
11 Gap

12 Arrow
13, 14 Guide bush
15 Working part
16 Bush
17 Holding device
18 Drive element
19 Retriever element
21 Shaft
22 Head
22' blank
23 Recess
24 Annular face
25 Through bore
26 Jacket face
27 Indentation
28 Protrusion
29, 31 Plane faces
32, 33 Edges
35 Recess
36 Indentation
37 Adhesive
38 Adhesive seam

What is claimed is:

1. A stand-alone punch for insertion into a green sheet punching device, comprising:

a metal shaft having a substantially constant diameter cylindrical outer surface that is provided adjacent one end of the shaft with at least one recess, and having a punching portion of the punch formed at the other end of the shaft; and, an annular metal head having an inner surface that surrounds the at least one recess such that said cylindrical outer surface and other punching end portion extend out of the head, and with the inner surface having an inwardly directed protrusion, created by plastic deformation of the head, which protrusion engages the at least one recess and thereby secures the head on the shaft by positive engagement.

2. The punch according to claim 1, wherein an indentation, embodied in the process of the production of the protrusion, is associated with the protrusion and is disposed directly opposite the protrusion on an outer surface of the head.

3. The punch according to claim 2, wherein the indentation has a shape corresponding to the shape of the recess.

4. The punch according to claim 2, wherein the indentation was formed in a non-metal-cutting shaping operation.

5. The punch according to claim 2, wherein the recess is disposed entirely inside the head.

6. The punch according to claim 2, wherein the indentation is disposed on the outer circumferential surface of the head.

7. The punch according to claim 1, wherein the recess is an annular bead.

8. The punch according to claim 1, wherein a plurality of recesses are disposed in an annular region of the shaft.

9. The punch according to claim 1, wherein the recess is defined by a concave annular face.

10. The punch according to claim 9, wherein the annular face is embodied without edges or shoulders.

11. The punch according to claim 1, wherein the head is embodied substantially cylindrically.

12. The punch according to claim 1, wherein the head has at least one substantially plane end face.

13. The punch die according to claim 12, wherein the end face is directly adjacent to the recess.

14. The punch according to claim 1, wherein the head has a through bore, which in the mounting of the head on the shaft has been constricted to such an extent, by plastic deformation of the head, that the shaft is retained without play in the through bore over the entire axial length of the head.

15. The punch according to claim 1, wherein the head has a through bore, which in the mounting of the head on the shaft has been constricted to such an extent, by plastic deformation of the head, that the shaft is retained without gaps in the through bore over the entire axial length of the head.

16. The punch according to claim 1, wherein the head comprises a metal that is different than the metal of the shaft.

17. The punch according to claim 1, wherein the plastically deformed head is secured on the shaft by positive engagement and additionally by material engagement.

18. The punch according to claim 17, wherein for securing the head by material engagement, an adhesive deposit is used, which is disposed in the recess of the shaft before the plastic deformation of the head.

19. The punch according to claim 17, wherein for securing the head by material engagement, adhesive is used, which is disposed in the recess of the shaft after the plastic deformation of the head.

20. A punching device having a punch according to claim 1.

* * * * *